US007803232B2

(12) United States Patent
Avelis et al.

(10) Patent No.: US 7,803,232 B2
(45) Date of Patent: Sep. 28, 2010

(54) MULTI-PASS INVERTING BOTTLE CLEANER

(75) Inventors: Julian P. Avelis, Crete, IL (US); Garrett McBrady, Frankfort, IL (US)

(73) Assignee: McBrady Engineering, Inc. IL (US)

( * ) Notice: Subject to any disclaimer, the term of this patent is extended or adjusted under 35 U.S.C. 154(b) by 848 days.

(21) Appl. No.: 11/601,570

(22) Filed: Nov. 17, 2006

(65) Prior Publication Data

US 2007/0163622 A1 Jul. 19, 2007

Related U.S. Application Data

(60) Provisional application No. 60/737,495, filed on Nov. 17, 2005.

(51) Int. Cl.
*B08B 9/093* (2006.01)

(52) U.S. Cl. ..... 134/22.18; 99/360; 198/470.1

(58) Field of Classification Search ..... None
See application file for complete search history.

(56) References Cited

U.S. PATENT DOCUMENTS

| | | | | |
|---|---|---|---|---|
| 1,144,023 | A | | 6/1915 | Beutlich |
| 1,717,998 | A | | 6/1929 | Olmsted |
| 1,997,792 | A | | 4/1935 | Holmquist |
| 2,094,398 | A | | 9/1937 | Dostal |
| 2,634,737 | A | | 4/1953 | Rowe |
| 2,675,011 | A | | 4/1954 | Maddaford |
| 3,108,682 | A | * | 10/1963 | Zipper ..... 198/626.1 |
| 3,129,713 | A | | 4/1964 | Read |
| 3,516,108 | A | | 6/1970 | Loeffler |
| 3,605,768 | A | * | 9/1971 | Golding ..... 134/62 |
| 4,010,774 | A | | 3/1977 | Fischer |
| 4,154,624 | A | | 5/1979 | Wahl et al. |
| 4,423,745 | A | | 1/1984 | Butt et al. |
| 4,667,690 | A | | 5/1987 | Hartnig |

FOREIGN PATENT DOCUMENTS

| | | |
|---|---|---|
| EP | 0 577 568 A1 | 6/1993 |
| WO | WO 2004/045784 A1 | 6/2004 |

* cited by examiner

*Primary Examiner*—Michael Kornakov
*Assistant Examiner*—Eric Golightly
(74) *Attorney, Agent, or Firm*—Eugene F. Friedman

(57) ABSTRACT

A bottle cleaner that inverts the bottles to spray solutions into them. The cleaner sends the bottles through two inverting passes for multiple stages of liquid cleaning. Thus, on the first pass, the bottles invert and receive, for example, a spray of a cleaning solution of some sort. The cleaner then returns the bottles to the upright orientation. On the second pass, the bottles again turn upside down and then may receive a liquid rinse. After returning the bottles to the normal orientation, the cleaner may then pass the bottles off to another location for further operations. Each pass of the bottles utilizes two sets of linked grippers arranged as a chain. One chain contacts the bottles on one side while the second chain contacts them on the other side. The two chains squeeze the bottles between them to firmly hold them. A single adjustment accomplishes a multitude of tasks.

60 Claims, 11 Drawing Sheets

MULTI-PASS INVERTING BOTTLE CLEANER

The present application claims the benefit of the filing of the U.S. provisional patent application Ser. No. 60/737,495 filed on Nov. 17, 2005.

BACKGROUND

Bottles and similar containers often must undergo a cleaning of some sort prior to their actual use. Particularly does this represent the situation where these items will hold some material consumable by animals, especially humans. In such cases, the bottles will experience a multiplicity of cleaning stages. In one of the stages, an actual cleaning solution will contact the containers' interiors. This serves to provide assurance that undesirable substances will undergo removal from the bottles. Subsequently, the bottles will experience a rinsing stage. This removes the cleaning solution itself from the bottles.

One particularly effective manner of carrying out the cleaning and rinsing involves inverting the bottles during each of the stages. The machinery then sprays the appropriate liquid into the containers while upside-down.

Inverting the bottles produces a number of desirable effects. First, it sprays liquids with the minimum level of contaminating agents on the bottles' interiors. Second, it provides a continuous spray of fresh liquid to remove the contaminants. Third, it allows the force of the spray itself contacting the interior surface to assist in the contaminant removal.

However, passing the containers through two separate washing areas (one of which may simply rinse the bottles) poses its own set or problems. One cause for concern involves the extensive floor area for two separate cleaning machines. Another requires a facile transfer between the two pieces of equipment.

Some prior efforts have inverted the bottles and then sent them through a plurality of wash stations before releasing them. U.S. Pat. No. 3,129,713 to P. C. Read, U.S. Pat. No. 4,010,774 to O. H. Fischer and U.S. Pat. No. 4,154,624 to A. Wahl et al. invert, submerge, and spray bottles to clean them. The bottles sit in pockets during the process. The submersion and pockets may leave cleaning solution on the bottles' exteriors after cleaning. Improved multi-pass cleaning equipment portends substantial advantages and savings to those filling and using containers.

SUMMARY

An improved bottle cleaner includes an intake area for receiving bottles in an upright orientation. A first moving device will grip these bottles while they sit in the upright orientation. The first moving device will then place the bottles, while gripped, into an inverted orientation and move them, while in the inverted orientation, through a first cleaning area. With the bottles in the first cleaning area, the moving device applies a first cleaning solution to them.

After the first cleaning solution is applied to the bottles, the first moving device moves the bottles out of the first cleaning area and afterwards returns them to the upright orientation. At that time, the first moving device releases the gripping of the bottles.

The bottle cleaner also includes an intermediate area for receiving the bottles, while in the upright configuration. This occurs after the bottles have moved out of the first cleaning area.

While the bottles remain in the upright orientation and in the intermediate area, a second moving device, forming part of the bottle cleaner, then serves to grip the bottles and place them, while gripped and after having moved into the intermediate area, into an inverted orientation. The second moving device then moves the bottles, while in the inverted orientation and after having moved into the intermediate area, through a second cleaning area.

While the bottles remain in the second cleaning area, the second moving device applies a second cleaning solution to them. Afterwards, the second moving device moves the bottles out of the second cleaning area. After having moved the bottles out of the second cleaning area, the second moving device returns the bottles to the upright orientation. After having accomplished this task, the second moving device releases the gripping of the bottles.

An improved method of cleaning bottles commences with receiving bottles in an upright orientation. It then proceeds to gripping the bottles, while in this upright orientation, with a first gripper. The bottles are then placed, while gripped, into an inverted orientation. The bottles, while in the inverted orientation, are then moved through a first cleaning area in which a first cleaning solution is applied to the bottles.

After the first cleaning solution is applied to the bottles, they are moved out of the cleaning area. After the bottles have been thusly moved, they are returned to the upright orientation. While the bottles are in the upright orientation after moving out of the first cleaning area, the gripping by the first gripper of the bottles is released.

After the bottles have been released from the gripping by the first gripper, they are gripped with a second gripper while in the upright orientation. While gripped by the second gripper, the bottles are again moved into an inverted orientation. They are then, while in the inverted orientation and while gripped by the second gripper, moved through a second cleaning area. While in the second cleaning area, a second cleaning solution is applied to the bottles.

After the second cleaning solution is applied to the bottles, they are moved out of the second cleaning area. They are then returned to then upright orientation. To complete the process, with the bottles in the upright orientation and after they have moved out of the second cleaning area, the gripping of the bottles by the second gripper is released.

DETAILED DESCRIPTION

Figure 1:
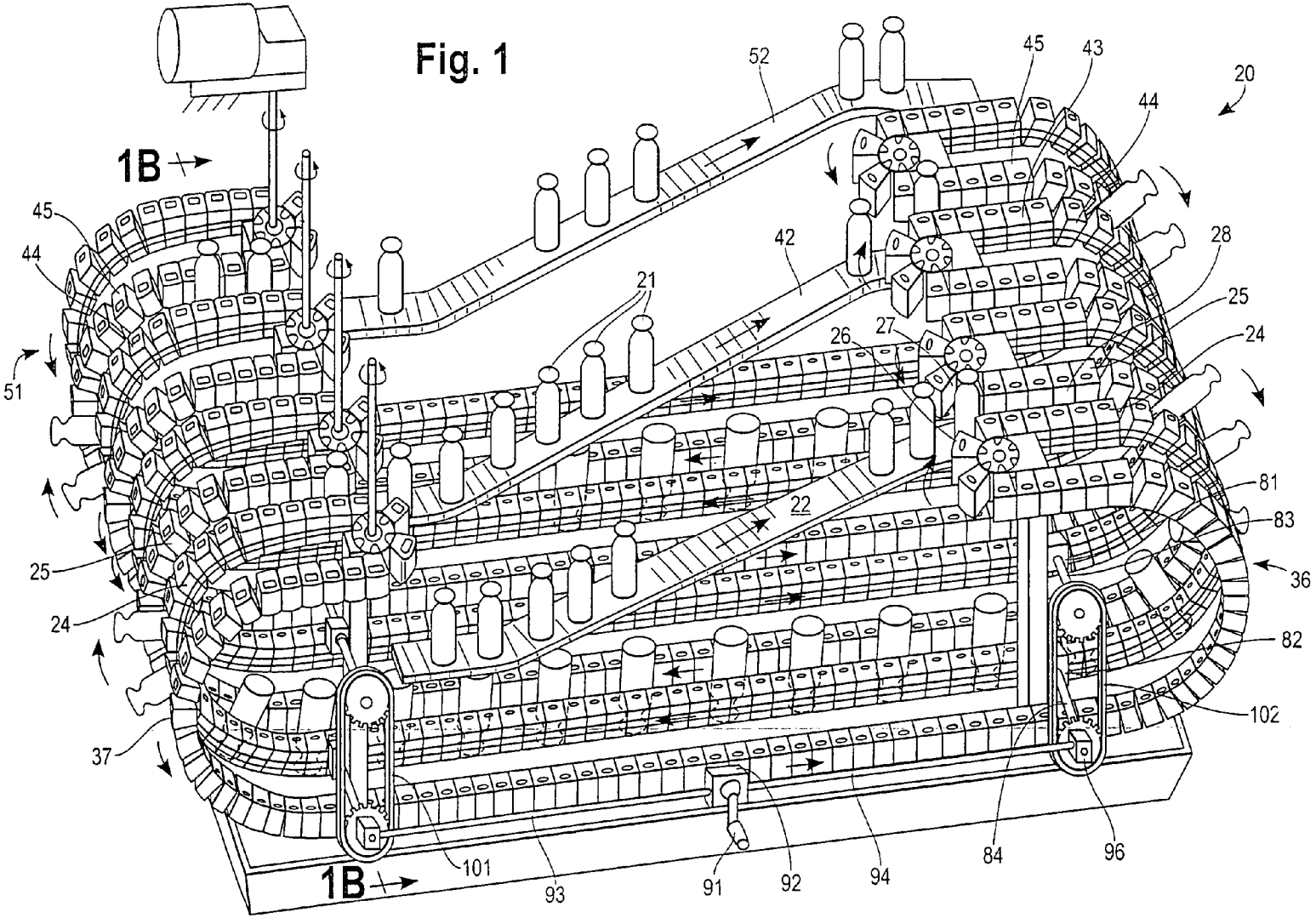
FIG. 1 gives an isometric view of a bottle cleaner twice inverting and spray cleaning bottles while inverted.
Figure 3:
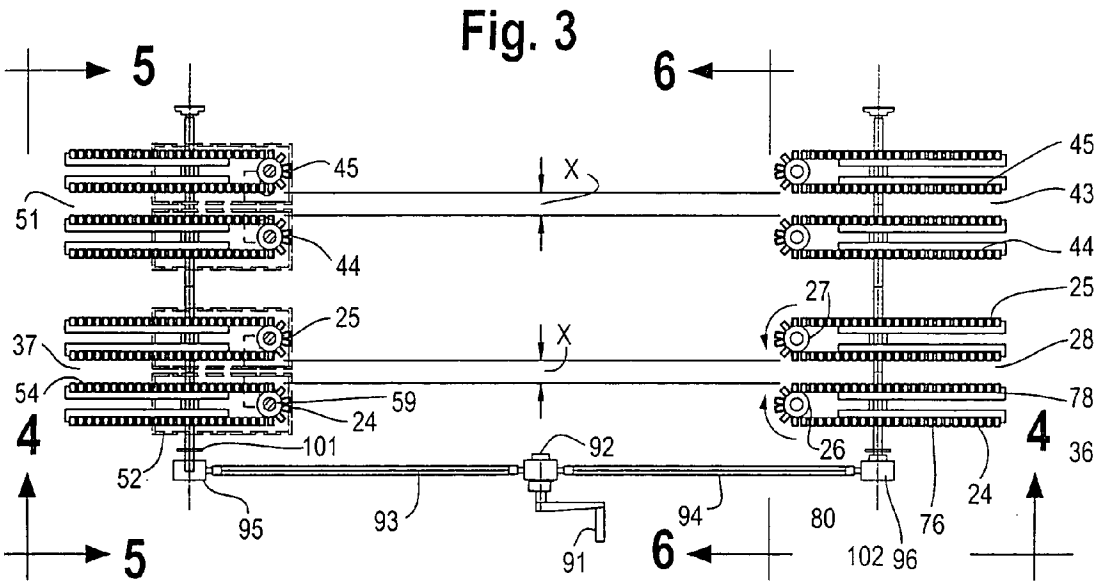
FIG. 3 gives a diagrammatic top plan view of the bottle cleaner of FIGS. 1 and 2.
Figure 4:
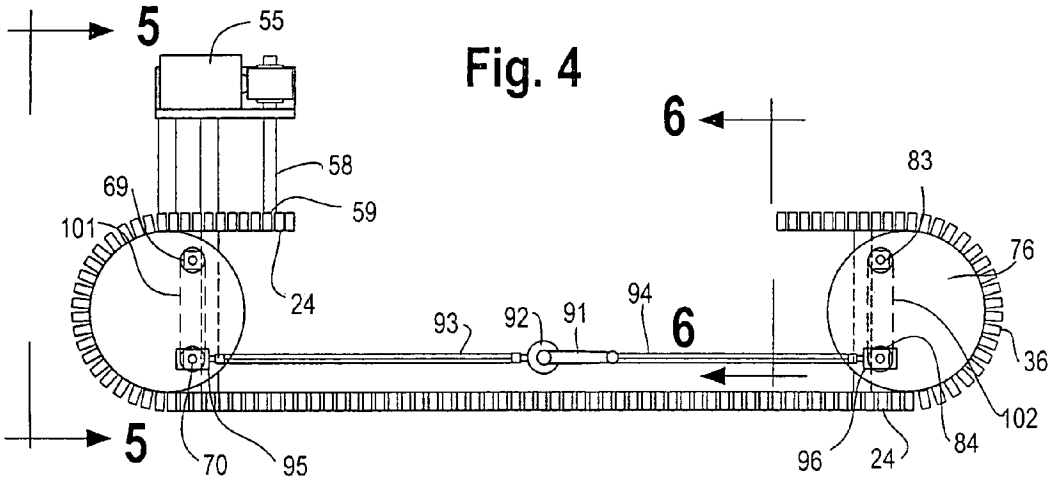
FIG. 4 has a side elevational diagrammatic view along the line 4-4 of the bottle cleaner of FIG. 3.
Figure 5:
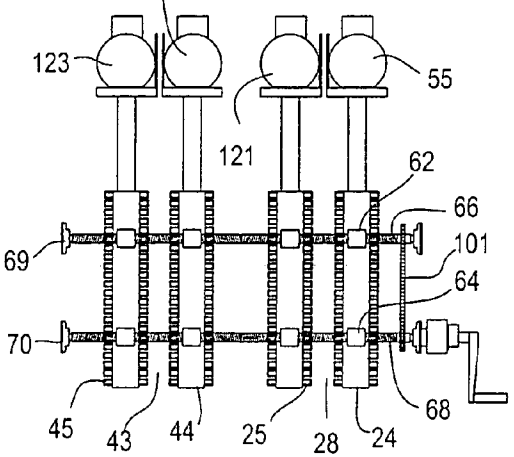
FIG. 5 illustrates an end elevational diagrammatic view along the line 5-5 of the bottle cleaner of FIGS. 3 and 4.

FIG. 1 shows a two-stage bottle cleaner generally at 20 in which bottles 21 which will undergo cleaning arrive along the conveyor 22. The bottles 21 move to the right until the two gripping chains 24 and 25 grab onto them. As seen in FIGS. 1 and 3, the belt chain 24, as seen from the top and at the right end of the cleaner 20, rotates in a clockwise direction at its turning point 26. At the corresponding turning point 27, the belt 25 rotates in the counterclockwise direction. With the belts 24 and 25 moving in this direction, they create the narrow shaft 28 between them. This shaft 28 moves to the right at the right end of the cleaner, taking the bottles in that direction as seen in FIGS. 1, 3, and 4.

Figure 1A:
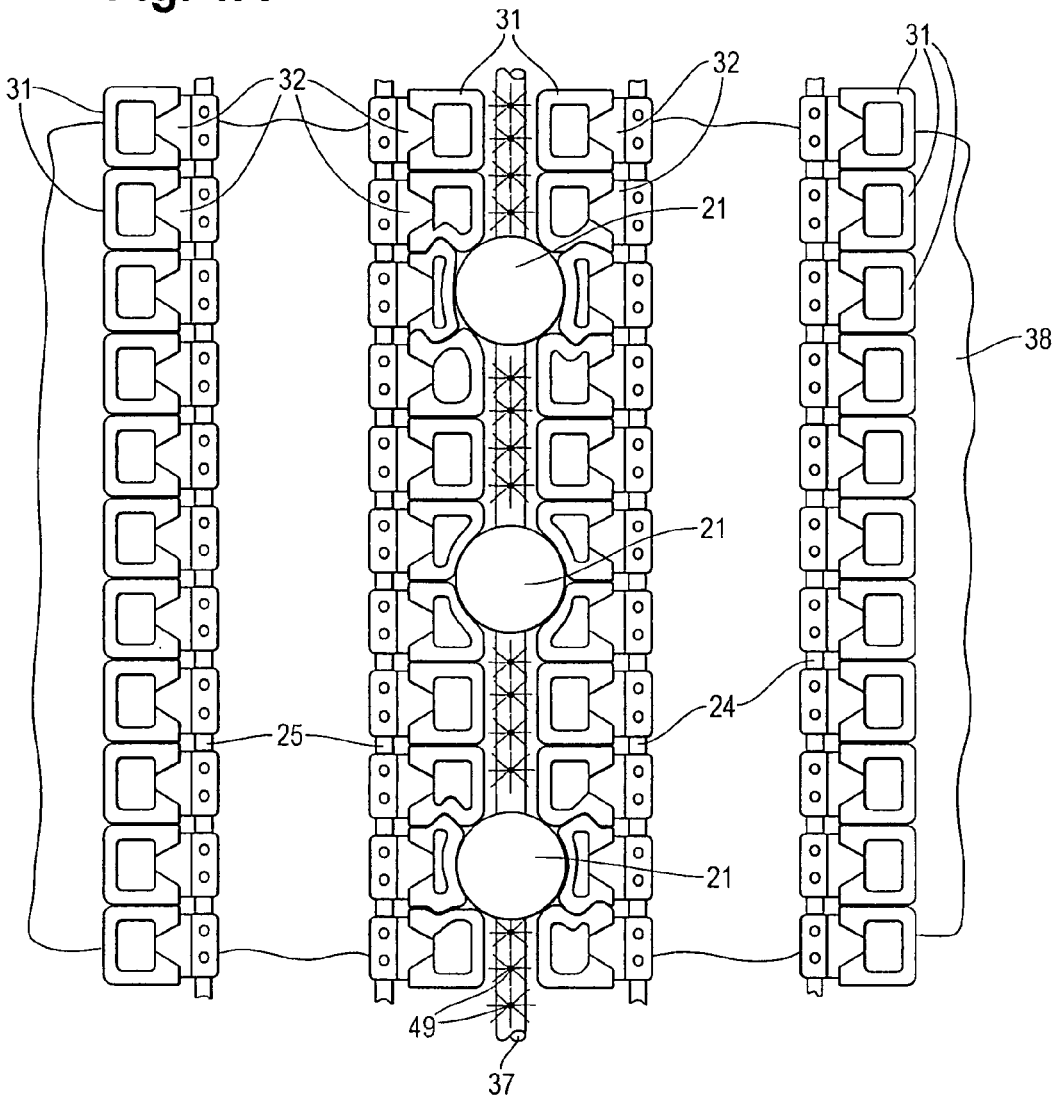
FIG. 1A gives a top plan view of a short segment of a chain holding bottles undergoing cleaning.
Figure 1B:
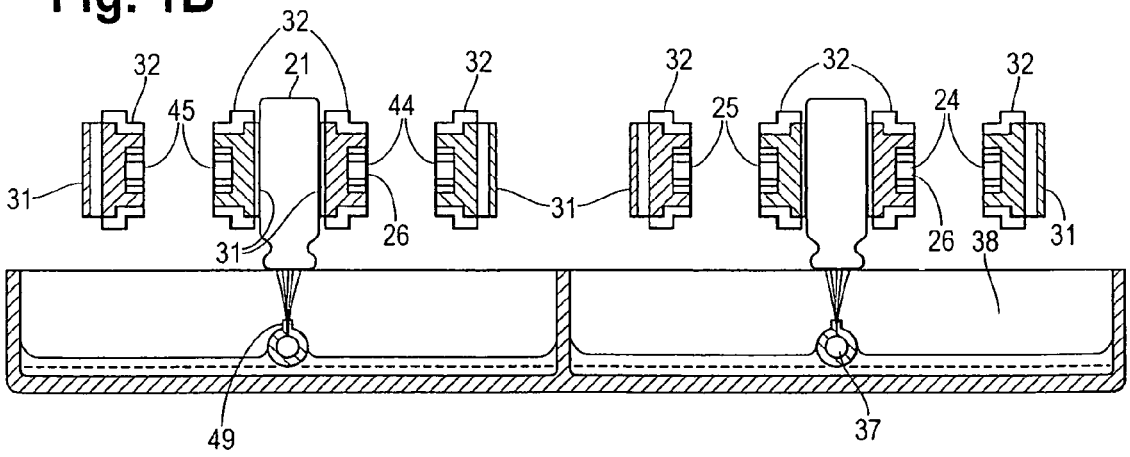
FIG. 1B gives a cross sectional view along the line 1B-1B of the bottle cleaner of FIG. 1.
Figure 2:
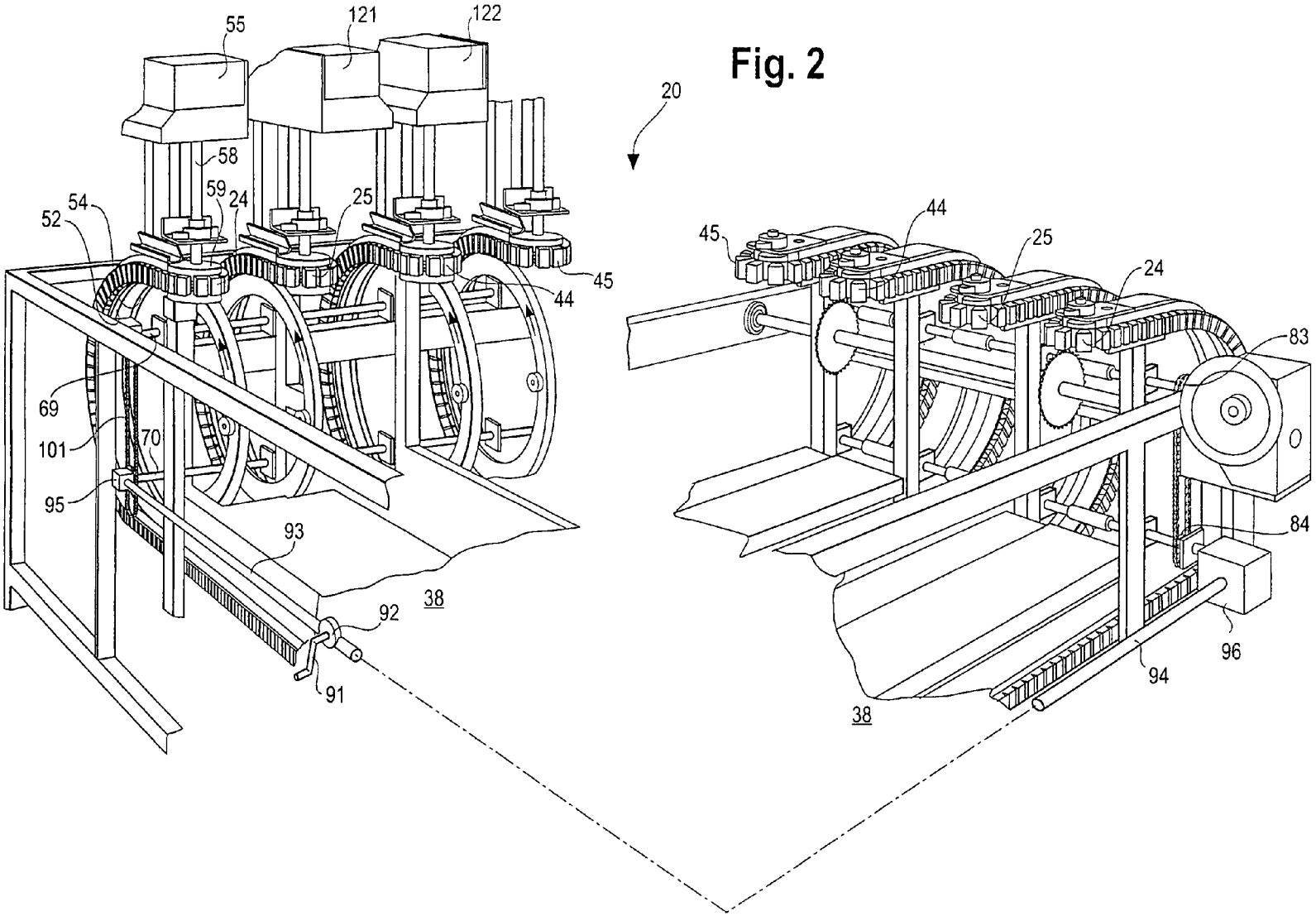
FIG. 2 provides a broken isometric view of the bottle cleaner of FIG. 1.

As seen in FIGS. 1, 1A, and 1B, the chains 24 and 25 include the polymer pads 31, obtained from TSE Industries, Inc., of Clearwater, Fla., attached to the metal chain skeleton 32 provided by Rexnord, Inc., of Grove City, Ohio. The pads 31 attached to the chains 24 and 25 serve to grip the bottles 21, hold onto them, and take then through the first stage of cleaning. As discussed below, similar pads on further chains will similarly hold onto and take the bottles through the second and possibly the third cleaning.

As the bottles 21 move to the right in FIG. 1 in the space 28 between the two chains 24 and 25, they reach the right end 36 of the cleaner 20 and rotate 180 degrees in the clockwise direction and invert. As seen in FIG. 1B, the bottles 21 receive a spray from the fluid head 37 for their first stage of cleaning. The liquid then drains off of the bottles 21 and into the pan 38.

The bottles 21 then reach the left side of the cleaner 20 as seen in the figures. The belts 24 and 25 return the bottles to the upright orientation and place then on the conveyor 42. The conveyor, in turn, takes the bottles to the right and into the space 43 between the second set of belts 44 and 45. The belts 44 and 45, similar to the first set of belts 24 and 25, grab the bottles, invert them, and send them over the spray 49 (as seen in FIG. 1B). The belts 44 and 45 then return the bottles 21 to the upright configuration at the left end 51 of the cleaner 20 and place them on the conveyor belt 52, seen in FIG. 1. The conveyor then takes the bottles and moves them off the cleaner 20 for further processing or, perhaps, storage.

Clearly, the spacing 28 between the belts 24 and 25 should have the appropriate width to firmly hold the bottles 21 without damaging them. Similarly, the same holds true for the spacing 43 between the belts 44 and 45. Further, since the same bottles 21 travel in the space 43 as in the space 28, these two spaces should have generally the same magnitude. Additionally, since each of the respective belt pairs 24 and 25 on one half of the machine and 44 and 45 on the other holds the bottles, inverts them, passes them through the respective sprays 37 and 49, and returns them upright, the spacings 28 and 43 between them should remain relatively uniform throughout the entire journey of the bottles 21 while in their grasp. Additionally, the utility of the cleaner 20 undergoes significant enhancement if it can accommodate bottles of different widths while maintaining the uniformity of the spacings 28 and 43 discussed above.

FIGS. 1 to 6 show components that can achieve the above objectives. As seen initially in FIG. 2, the belt 24 rides on the rails 52 and 54 located at the left end 51 of the cleaner 20. The belt 24 makes a 180 degree turn under the power of the motor 55. The motor 55, through the assistance of the shaft 58, drives the gear 59 to move the belt 24.

Figure 6:
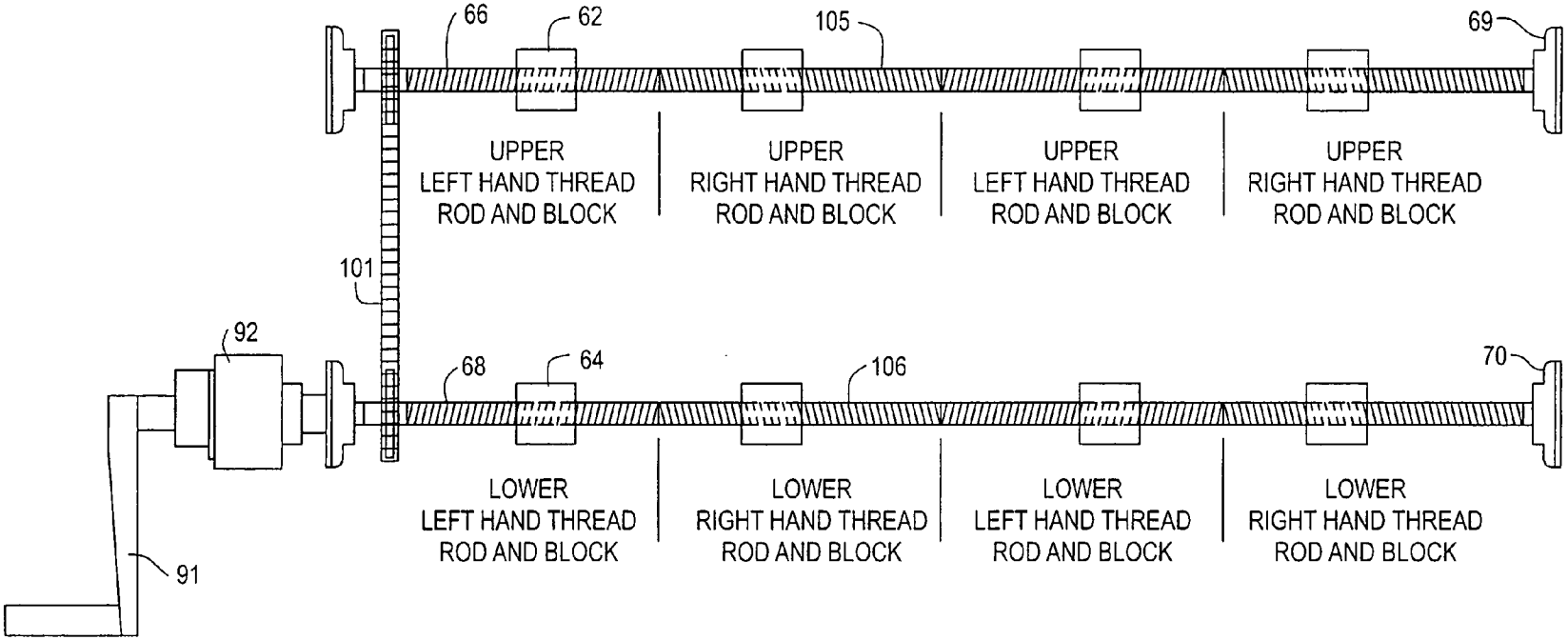
FIG. 6 sets forth a cross sectional diagrammatic view along the line 6-6 of the adjusting mechanism for different widths of bottles of the bottle cleaner of FIGS. 3 to 5.

The rails 52 and 54 and the motor 55 connect to the upper and lower blocks 62 and 64 as seen in FIG. 6. The blocks 62 and 64 ride on the left-hand screw thread sections 66 and 68 of the shafts 69 and 70, respectively.

Similarly, at the right end 36 of the cleaner 20 as seen in FIGS. 3 and 4, the belt 24 rides around the rails 76 and 78. It passes around the idler sprocket 80 in moving between the two rails 76 and 78. The rails 76 and 78 as well as the sprocket 80 all attach to the blocks 81 and 82 (FIG. 1) which ride on the shafts 83 and 84. The shafts 83 and 85 have the same construction as the shafts 69 and 70 of FIG. 6. Thus, as the shafts 66, 68, 83, and 84 turn to the right (or clockwise) direction in FIGS. 1 to 4, the blocks 62, 64, 81, and 82 all move into the paper in FIGS. 1 and 4 (or upward in FIG. 3 and to the right in FIG. 6). This causes the rails 52 and 54 on the left side and the rails 76 and 78 on the right side to move in the same direction. The motor 55 attached to the blocks 62 and 64 and the idler sprocket 80 attached to the block 81 and 82 also translate along the shafts 69, 70, 83 and 84 in the same direction. These components control the position of the belt 24 which must accordingly move in the same direction.

To maintain the belt in a vertical orientation, all four shafts 69, 70, 83, and 84 should all move in unison by equal amounts. Providing a single control for all four shafts will help achieve this goal. Accordingly, the hand crank 91 connects to the gear box 92. Turning the crank 91 rotates the shaft segments 93 and 94 which connect through the gear boxes 95 and 96 (as best seen in FIG. 3). The lower shafts 68 and 84 couple to the respective shaft segments 93 and 94 through the gear boxes 95 and 96, respectively. Accordingly, rotating the hand crank 91 causes the shafts 70 and 84 to rotate in the same direction by the same amount.

Additionally, the chain 101 couples the shafts 69 and 70 to each other so that the latter rotates in synchronization with the former. The chain 102 achieves the same result to rotate the shaft 84 with the shaft 83. Thus, turning the hand crank 91 causes equal rotation of the four shafts 69, 70, 83 and 84 in the same direction by the same amount. This causes the chain 23 to remain vertical and move toward or away from the near side of the cleaner 20.

A similar analysis applies to the chain 25, However, it couples to the shaft segments 105 and 106 of the shafts 69 and 70, respectively. However, the shaft segments 105 and 106 have the reverse thread from the segments 66 and 68, respectively. Thus, the chain 25 moves by the same amount but in the reverse direction from chain 24. Similar remarks apply to the right side of the cleaner 20 as seen in FIGS. 1, 3 and 4.

Accordingly, rotating the hand crank 91 in one direction will cause the chains 24 and 25 to move, for example, towards each other by equal amounts. This will allow the cleaner to handle smaller bottles. Moving the crank 91 in the opposite direction moves the chains 24 and 25 away from each other to handle larger bottles.

Naturally, the chain set 44 and 45 also couples to the shafts 69, 70, 83 and 84 in exactly the same fashion as the chain set 24 and 25. As the chains 24 and 25 move together for smaller bottles, the chains 44 and 45 move together by the same amount for the same bottles. Likewise, the chains moving 24 and 25 moving away from each other will be accompanied by the chains 44 and 45 moving away by the same distance for the same larger bottles. Either motion only involves turning the single hand crank 91 in one direction or the other.

Figure 7A:
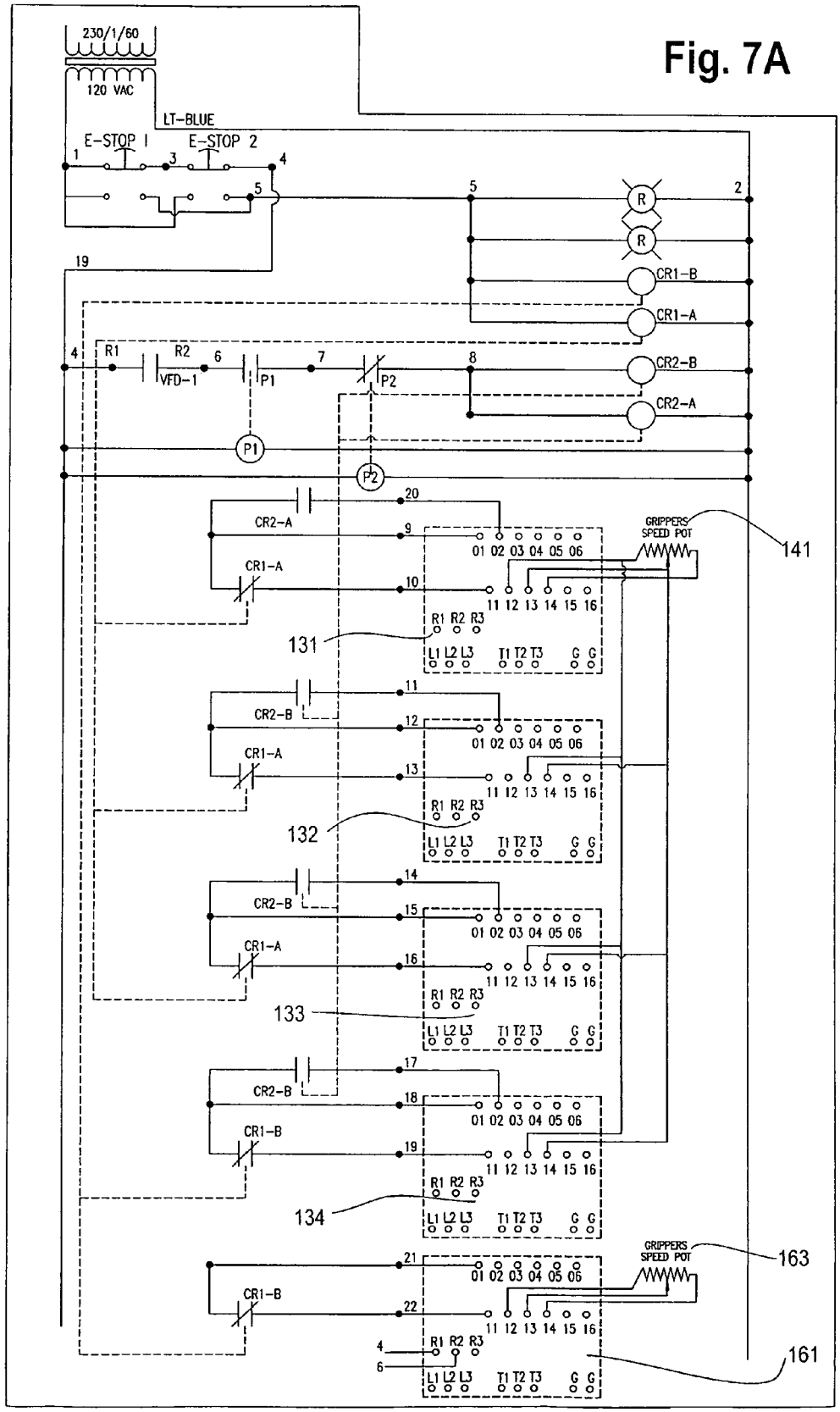
FIGS. 7A and 7B provide views of an electrical diagram for the bottle cleaner of FIGS. 1 TO 6.
Figure 7B:
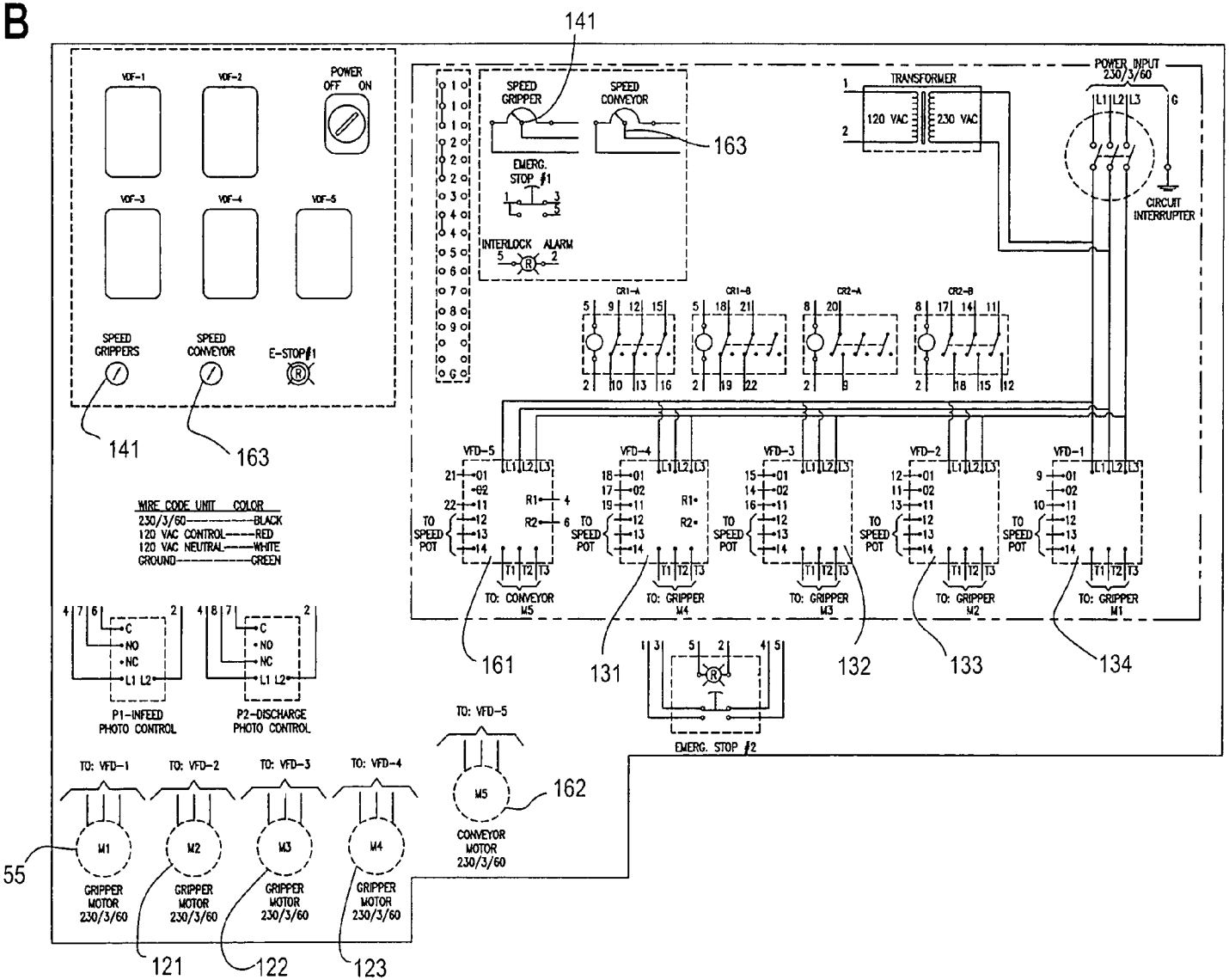
Figure 8:
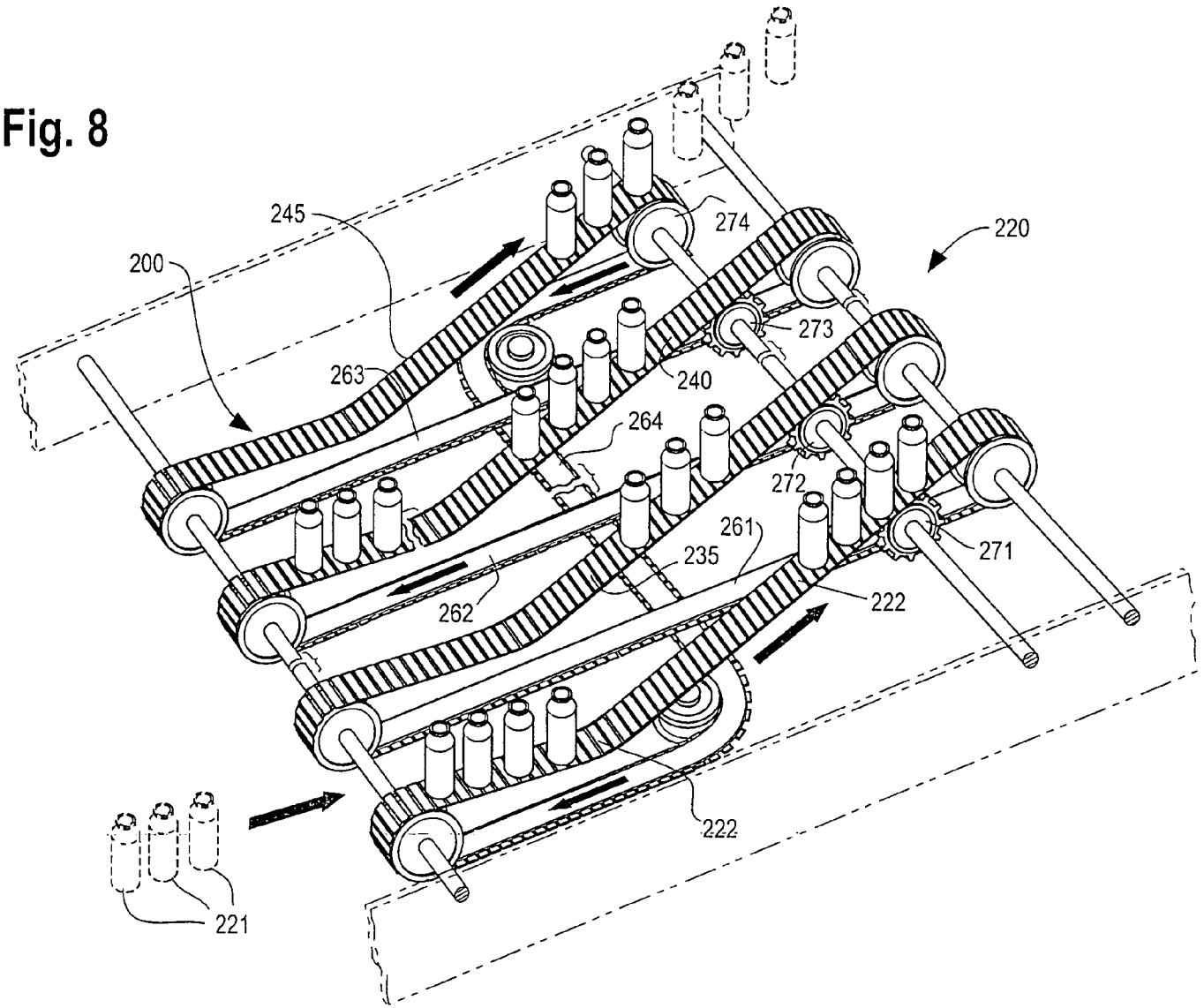
FIG. 8 gives an isometric view of a bottle cleaner very similar to that of FIGS. 1 to 7 except that it provides three separate washing lines for the bottles.

FIGS. 7A and 7B diagram the electrical circuit for the bottle cleaner 20 of the prior figures. As seen there, gripper chain motors 55, 121, 122, and 123 connect to the variable frequency drives ("VFD's") 131, 132, 133, and 134, respectively. The VFD's, are supplied for example by the Allen-Bradley Division of Rockwell Automation, Inc., of Milwaukee, Wis., as PowerFlex 4 Adjustable Frequency AC Drives. The VFD's accept a voltage from the gripper potentiometer 141. It then provides an a.c. current of specified magnitude and frequency to the motors 55, 121, 122, and 123. The specified and uniform magnitude and frequency of the voltage cause the four motors 55, 121, 122, and 123 to operate at the same speed. This results in the four gripper chains 24, 25, 44, and 45 all moving at the same velocity to securely hold and move the bottles 21 through the cleaner 20.

Changing the setting of the gripper potentiometer 141 alters the input voltage to the VFD's 131 to 134. This causes them to change the frequency (but generally not the voltage) they provide to their respective motors 55, 121, 122, and 123. This changes the speed at which the motors operate. But, they still operate at the same rotational speed as each other since they all receive an a.c. voltage of the same magnitude and frequency. This results in the motors 55, 121, 122, and 123, and thus their chains 24, 25, 44, and 45, changing their speed, but-continuing to operate at the same speed as each other as desired to facilely handle the bottles.

Also of interest in FIGS. 7A and 7B is the additional VFD 161. This VFD 161 connects to the motor 162 which powers the conveyors 22, 42, and 52 in FIG. 1. The conveyor potentiometer 163 connects to the VFD 161 to control the speed of the conveyor motor 162 and thus the conveyors 22, 42, and 52.

FIGS. 8 to 11 show a bottle cleaner generally at 220 very similar to that of the prior figures. As seen there, however, the cleaner 220 provides for three, as opposed to two, stages of inverted spray cleaning. As seen there, the bottles 221 initially enter upon the first conveyor 222 which takes them to the first set of gripping chains 225 powered by the motors 230. The chains 225 invert the bottles and carry them through the first cleaning stage 231. After returning to the upright position, the bottles are carried by the second conveyor 235 to the second set of gripper chains 236 which inverts them, carries them through the second cleaning area 237. The chains 236 uprights the bottles 221 and place them on the third conveyor 240. The third conveyor 240 then takes the bottles to the third set of gripper chains 243 which inverts them and take them through the third cleaning section 244. Afterwards, the third set of gripper chains 243 places the bottles in the upright orientation on the fourth conveyor 245 which discharges the bottles from the cleaner 220.

As with the cleaner 20 of the earlier figures, the three-stage cleaner 220 presents the hand crank 250. Moving the crank 250 simultaneously adjusts the distance between the two gripper chains of each of the three chain sets 225, 236, and 243. As before, the distance between the two chains of each of the three sets remain the same as each other during the adjustment process to accommodate bottles of different sizes. As seen especially in FIGS. 8 and 10, the conveyor belts 222, 235, 240, and 245 actually form portions of one very long conveyor indicated generally at 260. The conveyor 260 includes the belts 222, 235, 240, and 245 and the interconnecting sections 261, 262, 263, and 264. The rod 268 turns under the influence of the motor 269 and causes the sockets 271, 272, 273, and 274 to turn and move the conveyor system 260. Similar remarks apply to the conveyors 22, 42, and 52 of FIGS. 1 to 7B.

Figure 9:
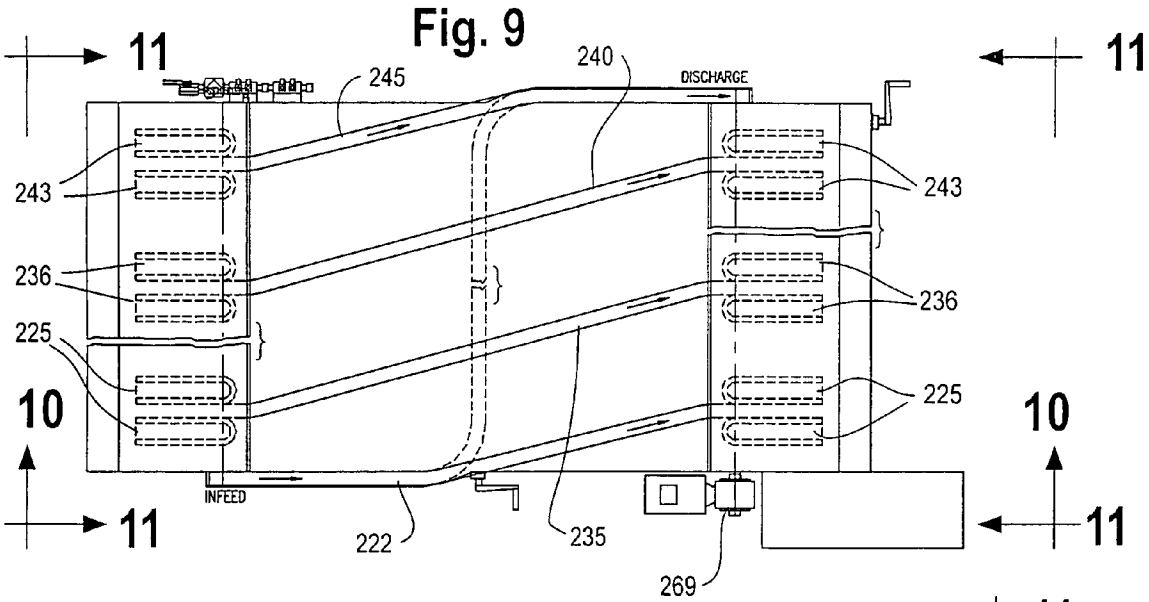
FIG. 9 provides a diagrammatic top plan view of the three-stage bottle cleaner of FIG. 8.
Figure 10:
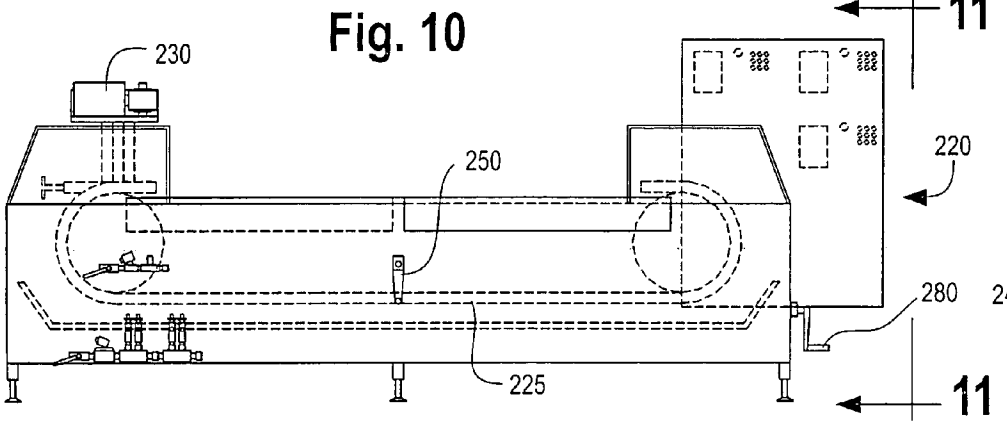
FIG. 10 gives a front elevational view along the line 10-10 of the three stage bottle cleaner of FIGS. 9 and 10.
Figure 11:
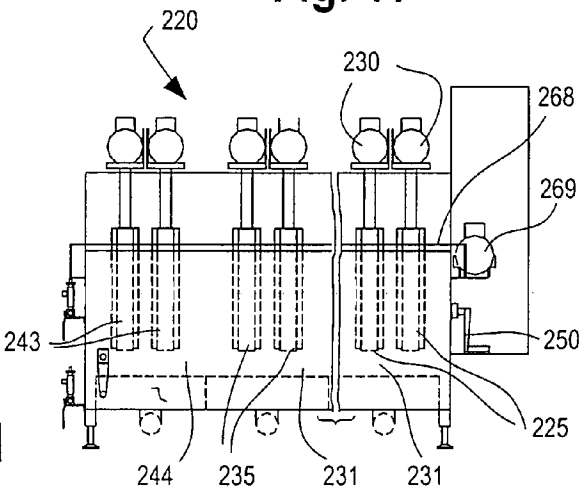
FIG. 11 provides an end elevational view along the line 11-11 of the three-stage bottle cleaner of FIG. 9.

As seen in FIGS. 9 and 10, the handle 280 raises and lowers the entire gripping and moving mechanism of the three cleaning areas 231, 237, and 244. This permits the cleaner 220 to accommodate bottles of different heights. The same remarks apply to the cleaner 20 of the prior figures.

Figure 12:
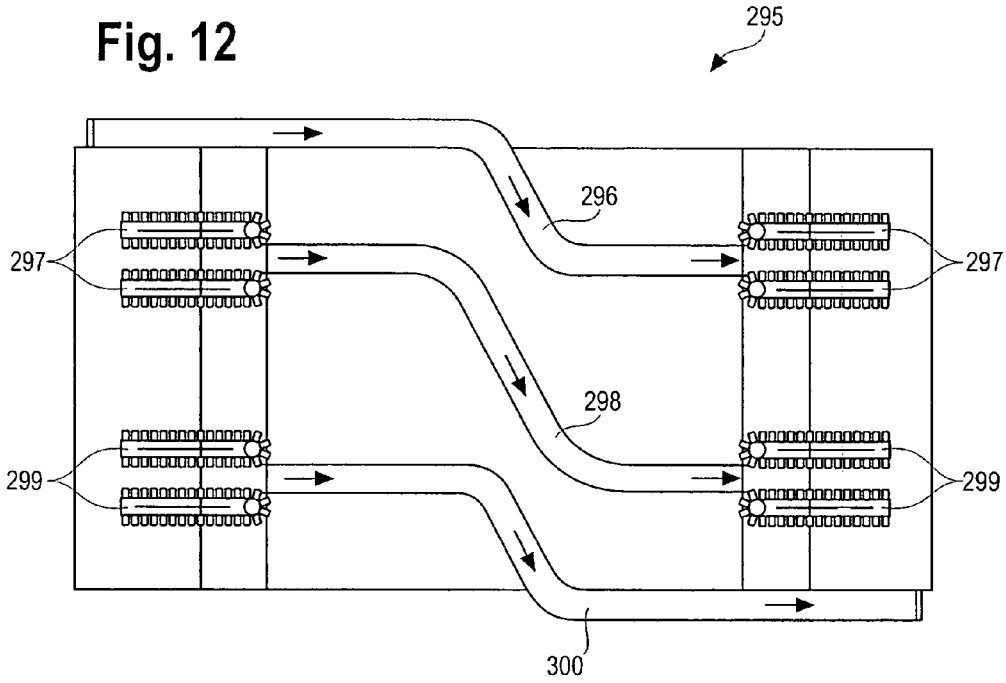
FIG. 12 gives a top plan diagrammatic view of the path followed by bottles passing through the cleaner of FIGS. 1 to 6.
Figure 13:
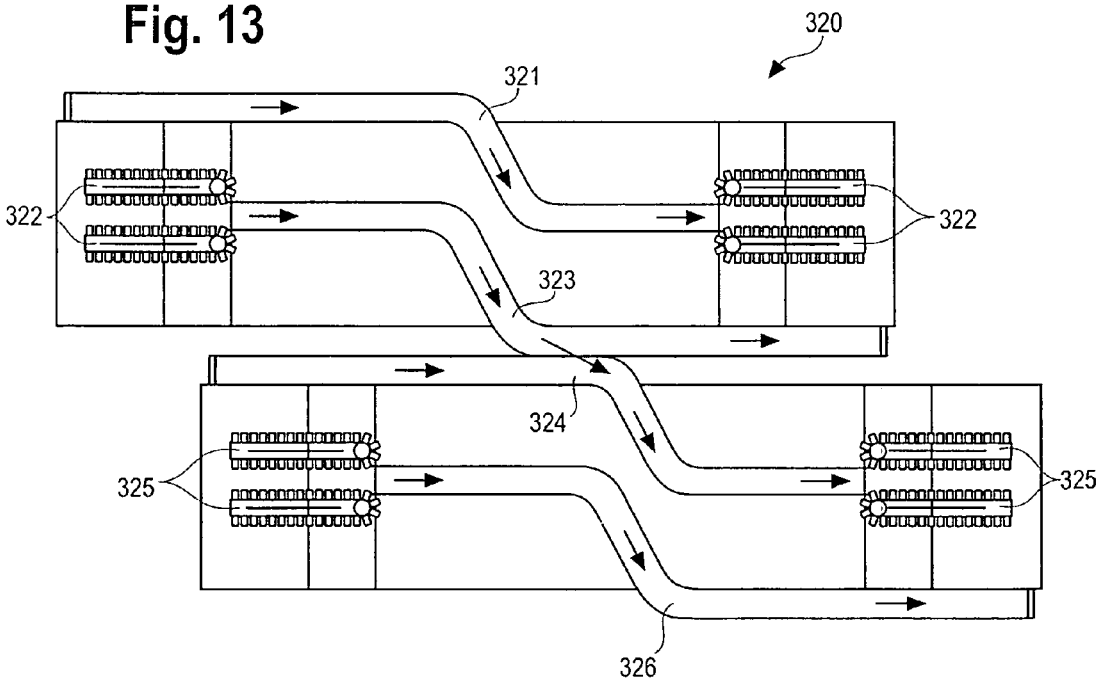
FIG. 13 provides a diagram of a cleaner similar to that of FIG. 12 but with a modified configuration and path for the bottles.

FIG. 12 diagrams the movement of bottles through a cleaner indicated generally at 295 similar to that of the cleaner 20 in FIGS. 1 to 7B. As seen in FIG. 12, the bottles enter the cleaner along the first conveyor 296 which takes them to the first set of gripper chains 297. The firs set of gripper chains 297 inverts the bottles and takes them through the first stage of cleaning. The gripper chains 297 then upright the bottles and places them on the second conveyor 298. The second conveyor 298 then carries the bottles to the second gripper chains 299 which invert and take them through the second cleaning area. The then places the bottles in the upright orientation and onto the third conveyor 30 which discharges them from the cleaner The cleaner generally 320 in FIG. 13 staggers the location of the two stages of cleaning. There, the first conveyor 321 takes the bottles to the first set of grippers 322, which of course invert them, moves them through the first cleaning stage, upright them and place them on the second conveyor 323. From there, the bottles travel on the third conveyor 324 to the second set of gripper chains 325. The gripper chains 325 again invert the bottles, carry them through the second cleaning area, and, after uprighting them, places them on the fourth conveyor 326 which discharges them from the cleaner 320.

Figure 14:
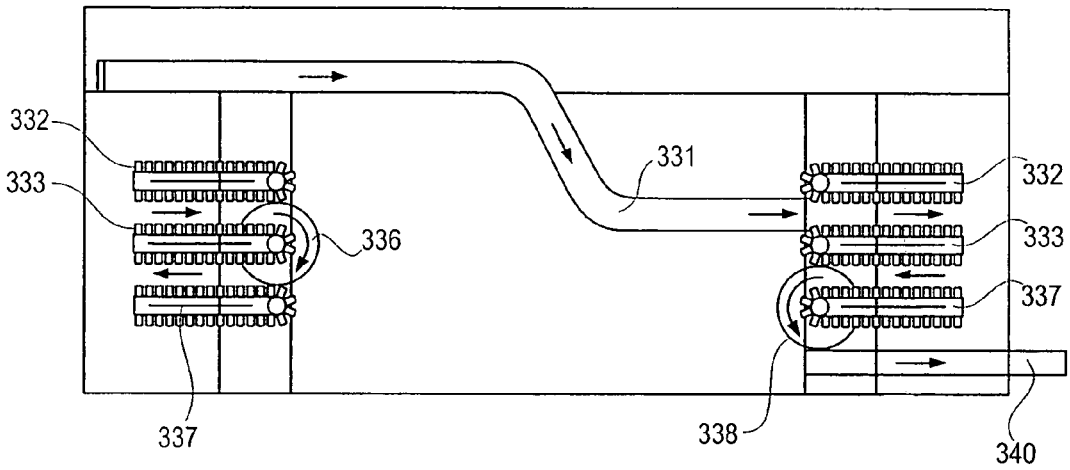
FIG. 14 portrays a diagram for a cleaner similar to those of FIGS. 12 and 13 but with a different and modified path for the bottles.

The cleaner generally at 330 in FIG. 14 receives the bottles on the first conveyor 331 which carries them to the first and second gripper chains 332 and 333, respectively. The two chains 332 and 333 invert the bottles and take them through the first cleaning area. The bottles then appear upright between the two chains 332 and 333 at the left end of the cleaner 330. The bottles departing the space between the two chains 332 and 333 then enter upon the turning plate, or turntable, 336 which places them between the second chain 333 and the third chain 337. The second and third chains 333 and 337, respectively, then move the bottles in the opposite direction from which they moved while between the first two chains 332 and 333. The second and third chains 333 and 337 invert the bottles and carry them through the second cleaning area. Afterwards, the two chains 333 and 337 replace the bottles in the upright orientation and upon the second turntable 338. The turntable 338 reverses the direction of the bottles and places them on the second conveyor 340 for discharge.

Figure 15:
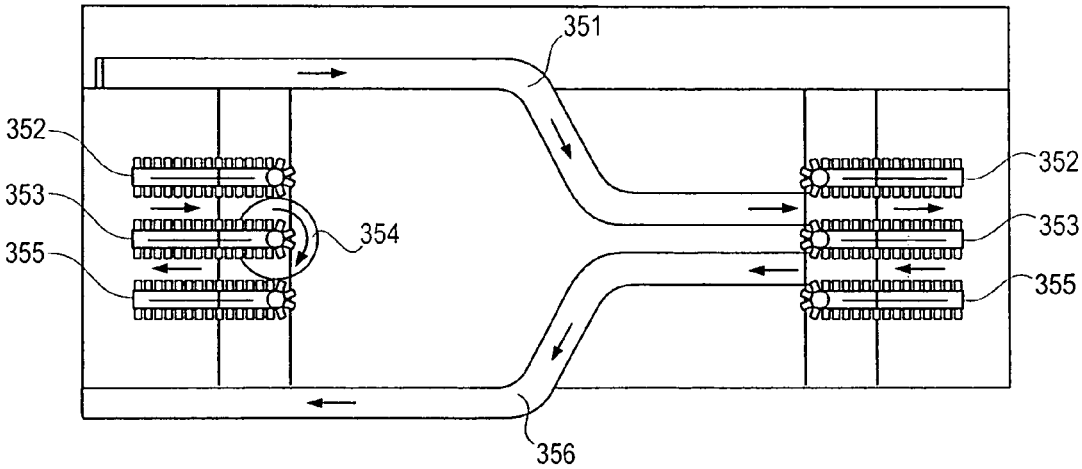
FIG. 15 diagrams a cleaner similar to those of FIGS. 12 to 14 but showing a possible further modified configuration and path for the bottles.

The cleaner 350 in FIG. 15 appears similar to that of the prior FIG. 14. Again, the bottles enter on the first conveyor 351 and are grabbed by the two gripper chains 352 and 353. The gripper chains invert the bottles and pass them through the first cleaning stage. After being uprighted, the bottles turn 180 degrees around on the turntable 354 and are entrained between the second gripper chain 353 and the third gripper 355. The two gripper chains 353 and 355 invert the bottles and pass them through the second cleaning area. After uprighting the bottles, the chains 353 and 355 place the bottles on the second conveyor 356 which discharges them from the cleaner 350 in the opposite direction from the second, or discharge, conveyor 340 in the cleaner 330 in FIG. 14.

Accordingly, what is claimed is:

1. A method of cleaning bottles comprising:

A. receiving bottles in an upright orientation;

B. gripping with a first gripper said bottles while in said upright orientation;

C. placing said bottles, while gripped, into an inverted orientation;

D. moving said bottles, while in said inverted orientation and with a horizontal component of motion, through a first cleaning area;

E. while in said first cleaning area, applying a first cleaning solution to said bottles;

F. after said first cleaning solution is applied to said bottles, moving said bottles with a horizontal component of motion out of said first cleaning area;

G. after said bottles are moved out of said first cleaning area; returning said bottles to said upright orientation;

H. while said bottles are in said upright orientation after moving out of said first cleaning area, releasing said gripping by said first gripper of said bottles;

I. after said bottles have been released from said gripping by said first gripper, gripping with a second gripper said bottles, while in said upright orientation;

J. placing said bottles, while gripped by said second gripper, into an inverted orientation;

K. moving said bottles, while in said inverted orientation and while gripped by said second gripper and with a horizontal component of motion, through a second cleaning area;

L. while in said second cleaning area, applying a second cleaning solution to said bottles;

M. after said second cleaning solution is applied to said bottles, moving said bottles with a horizontal component of motion out of said second cleaning area;

N. after said bottles are moved out of said second cleaning area; returning said bottles to said upright orientation; and O. while said bottles are in said upright orientation after moving out of said second cleaning area, releasing said gripping of said bottles by said second gripper.

2. The method of claim 1 wherein said first gripper grips said bottles by touching the exterior of each of said bottles with first and second contacts on generally opposite sides of said each of said bottles.

3. The method of claim 2 wherein said first and second contacts form parts of first and second continuous chains, respectively, spaced apart from each other.

4. The method of claim 3 wherein said first and second contacts comprise pads attached to links of said first and second chains, respectively.

5. The method of claim 3 further including moving said first and second chains, while in contact with said bottles, substantially in the same direction.

6. The method of claim 5 further including changing the distance between said first and second chains while maintaining said first and second chains equidistant from each other where said first and second chains are in contact with said bottles.

7. The method of claim 6 further including moving both said first and second chains at substantially the same speed.

8. The method of claim 7 further including selectively changing said speed.

9. The method of claim 7 further including operating first and second electric motors, coupled to said first and second chains, respectively, at the same speed.

10. The method of claim 9 further including maintaining the output of first and second variable frequency drives, coupled respectively to said first and second motors, at the same frequency.

11. The method of claim 10 further including changing the input voltage to said first and second variable frequency drives.

12. The method of claim 8 further including selectively changing a height of said first and second chains from a first configuration to a second configuration above said first cleaning area.

13. The method of claim 12 further including, when changing the height of said first and second chains from said first to said second configuration, moving all of the components of said first and second chains in substantially the same direction by substantially the same amount.

14. The method of claim 13 wherein said second gripper grips said bottles by touching the exterior of each of said bottles with third and fourth contacts on generally opposite sides of said each of said bottles, said third and fourth contacts form parts of third and fourth continuous chains, respectively, spaced apart from each other, and said third and fourth contacts comprise pads attached to links of said third and fourth chains, respectively and further including moving said third and fourth chains, while in contact with said bottles, substantially in the same direction and further including operating first, second, third, and fourth electric motors, coupled to said first, second, third, and fourth chains, respectively, at the same speed.

15. The method of claim 14 further maintaining the output of first and second variable frequency drives, coupled respectively to said first, second, third, and fourth motors, at the same frequency.

16. The method of claim 15 further including selectively changing the input voltage to said first and second variable frequency drives.

17. The method of claim 2 wherein said second gripper grips said bottles by touching the exterior of each of said bottles with third and fourth contacts on generally opposite sides of said each of said bottles.

18. The method of claim 17 wherein said first and second contacts form parts of first and second continuous chains, respectively, spaced apart from each other and said third and fourth contacts form parts of third and fourth continuous chains, respectively, spaced apart from each other.

19. The method of claim 18 wherein said first and second contacts comprise pads attached to links of said first and second chains, respectively, and said third and fourth contacts comprise pads attached to links of said third and fourth chains, respectively.

20. The method of claim 18 further including moving said first and second chains, while in contact with said bottles, substantially in a same first direction and moving said third and fourth chains, while in contact with said bottles substantially in the same second direction.

21. The method of claim 20 further including changing the distance between said first and second chains while maintaining said first and second chains equidistant from each other where said first and second chains are in contact with said bottles and changing the distance between said third and fourth chains while maintaining said third and fourth chains equidistant from each other where said third and fourth chains are in contact with said bottles.

22. The method of claim 21 further including moving said first, second, third, and fourth chains at substantially the same speed.

23. The method of claim 22 further including selectively changing said speed.

24. The method of claim 22 further including operating first, second, third, and fourth electric motors coupled respectively to said first, second, third, and fourth chains at substantially the same speed.

25. The method of claim 24 further including maintaining the output of first, second, third, and fourth variable frequency drives, coupled respectively to said first, second, third, and fourth motors, respectively, at the same frequency.

26. The method of claim 25 further including selectively changing the input voltage to said first, second, third, and fourth variable frequency drives.

27. The method of claim 24 further including changing a height of said first and second chains from a first configuration to a second configuration above said first cleaning area and a height of said third and fourth chains from a third configuration to a fourth configuration above said second cleaning area.

28. The method of claim 27 further including, when changing the height of said first, and second chains from said first configuration to said second configuration, and said third and fourth chains from said third configuration to said fourth configuration, moving all of the components of said first, second, third, and fourth chains in substantially the same direction by substantially the same amount.

29. The method of claim 28 operating first, second, third, and fourth electric motors coupled respectively to said first, second, third, and fourth chains at substantially the same speed.

30. The method of claim 29 further including maintaining the output of first, second, third, and fourth variable frequency drives, coupled respectively to said first, second, third, and fourth motors, respectively, at the same frequency.

31. The method of claim 30 further including selectively changing the input voltage to said first, second, third, and fourth variable frequency drives.

32. The method of claim 22 further including carrying said bottles to said first and second chains with a first conveyor and carrying said bottles from said first and second chains to said third and fourth chains with a second conveyor.

33. The method of claim 32 further including moving said first and second conveyors at substantially the same speed.

34. The method of claim 33 further including selectively changing the speed at which said first and second conveyors are moved.

35. The method of claim 34 further including carrying said bottles away from said third and fourth chains with a third conveyor.

36. The method of claim 35 wherein said third conveyor carries said bottles at substantially the same speed that said first and second conveyors carry said bottles.

37. The method of claim 36 further including selectively changing the speed at which said third conveyor carries said bottles.

38. The method of claim 6 further including, while changing the distance between said first and second chains, maintaining the center point of the distance between said first and second chains stationary where said first and second chains are in contact with said bottles.

39. The method of claim 21 further including, while changing the distance between said first and second chains, maintaining the center point of the distance said first and second chains stationary where said first and second chains are in contact with said bottles and, while changing the distance between said third and fourth chains, maintaining the center point of the distance said third and fourth chains stationary where said third and fourth chains are in contact with said bottles.

40. The method of claim 5 further including changing the direction of said first and second chains by about 180 degrees while said first and second chains are in contact with said bottles.

41. The method of claim 20 further including changing the direction of said first and second chains by about 180 degrees while said first and second chains are in contact with said bottles and changing the direction of said third and fourth chains by about 180 degrees while said third and second fourth are in contact with said bottles.

42. A method of cleaning bottles comprising:

A. receiving bottles in an upright orientation;

B. gripping with a gripper said bottles while in said upright orientation;

C. placing said bottles, while gripped, into an inverted orientation;

D. moving said bottles, while in said inverted orientation and with a horizontal component of motion, through a cleaning area;

E. while in said cleaning area, applying a cleaning solution to said bottles

F. after said cleaning solution is applied to said bottles, moving said bottles with a horizontal component of motion out of said cleaning area; and G. after said bottles are moved out of said cleaning area; returning said bottles to said upright orientation.

43. The method of claim 42 wherein said gripper grips said bottles by touching the exterior of each of said bottles with first and second contacts on generally opposite sides of said each of said bottles.

44. The method of claim 43 wherein said first and second contacts form parts of first and second continuous chains, respectively, spaced apart from each other.

45. The method of claim 44 wherein said first and second contacts comprise pads attached to links of said first and second chains, respectively.

46. The method of claim 45 further including moving said first and second chains, while in contact with said bottles, substantially in the same direction.

47. The method of claim 46 further including changing the distance between said first and second chains while maintaining said first and second chains equidistant from each other where said first and second chains are in contact with said bottles.

48. The method of claim 47 further including moving both said first and second chains at substantially the same speed.

49. The method of claim 48 further including selectively changing said speed.

50. The method of claim 48 further including operating first and second electric motors, coupled to said first and second chains, respectively, at the same speed.

51. The method of claim 5 further including maintaining the output of first and second variable frequency drives, coupled respectively to said first and second motors, at the same frequency.

52. The method of claim 51 further including changing the input voltage to said first and second variable frequency drives.

53. The method of claim 49 further including selectively changing a height of said first and second chains from a first configuration to a second configuration above said cleaning area.

54. The method of claim 53 further including, when changing the height of said first and second chains from said first to said second configuration, moving all of the components of said first and second chains in substantially the same direction by substantially the same amount.

55. The method of claim 45 further including carrying said bottles to said first and second chains with a conveyor.

56. The method of claim 55 wherein said conveyor is a first conveyor and further including carrying said bottles away from said first and second chains with a second conveyor.

57. The method of claim 56 wherein said second conveyor carries said bottles at substantially the same speed that said first conveyor carries said bottles.

58. The method of claim 57 further including selectively changing the speed at which said second conveyor carries said bottles.

59. The method of claim 57 further including, while changing the distance between said first and second chains, maintaining the center point of the distance between said first and second chains stationary where said first and second chains are in contact with said bottles.

60. The method of claim 46 further including changing the direction of said first and second chains by about 180 degrees while said first and second chains are in contact with said bottles.

* * * * *